US008677983B2

(12) United States Patent
Callander et al.

(10) Patent No.: US 8,677,983 B2
(45) Date of Patent: Mar. 25, 2014

(54) TRENCH CLAY TARGET TRAP MACHINE

(75) Inventors: Graham Charles Callander, Christchurch (NZ); John Richard East, Christchurch (NZ); Michael Henry Owens, Christchurch (NZ); Bruce Gerald Rickard, Christchurch (NZ)

(73) Assignee: Canterbury Trap International Limited, Christchurch (NZ)

( * ) Notice: Subject to any disclaimer, the term of this patent is extended or adjusted under 35 U.S.C. 154(b) by 414 days.

(21) Appl. No.: 12/737,400

(22) PCT Filed: Jul. 8, 2009

(86) PCT No.: PCT/NZ2009/000136

§ 371 (c)(1),
(2), (4) Date: Apr. 21, 2011

(87) PCT Pub. No.: WO2010/005323

PCT Pub. Date: Jan. 14, 2010

(65) Prior Publication Data

US 2011/0186023 A1 Aug. 4, 2011

(30) Foreign Application Priority Data

Jul. 8, 2008 (NZ) ..... 569677

(51) Int. Cl.
*F41J 5/18* (2006.01)

(52) U.S. Cl.
CPC ..... *F41J 5/18* (2013.01)
USPC ..... 124/9; 124/6; 124/7; 124/8

(58) Field of Classification Search
CPC ..... F41J 9/18; F41J 9/32; F41J 9/30
USPC ..... 124/6, 7, 8, 9
See application file for complete search history.

(56) References Cited

U.S. PATENT DOCUMENTS

| | | | | | |
|---|---|---|---|---|---|
| 2,310,746 | A | * | 2/1943 | Parker et al. | 124/8 |
| 2,666,424 | A | * | 1/1954 | Foster | 124/9 |
| 2,668,526 | A | * | 2/1954 | Woolsey | 124/9 |
| 2,711,726 | A | * | 6/1955 | Darrell | 124/6 |
| 2,928,383 | A | * | 3/1960 | Ohlson | 124/8 |
| 3,304,928 | A | * | 2/1967 | Darrell | 124/47 |
| 3,621,828 | A | * | 11/1971 | Schreiner | 24/8 |
| 3,680,863 | A | * | 8/1972 | Wallace et al. | 273/362 |
| 3,722,495 | A | * | 3/1973 | Hansen | 124/9 |
| 3,821,945 | A | * | 7/1974 | Foster | 124/9 |
| 3,937,203 | A | * | 2/1976 | Riedmueller et al. | 124/8 |
| 3,937,204 | A | * | 2/1976 | Alday et al. | 124/9 |
| 4,014,310 | A | * | 3/1977 | Laporte et al. | 124/6 |
| 4,146,007 | A | * | 3/1979 | Alday et al. | 124/9 |
| 4,706,641 | A | * | 11/1987 | Cote et al. | 124/8 |
| 4,747,390 | A | * | 5/1988 | Storm | 124/6 |

(Continued)

FOREIGN PATENT DOCUMENTS

DE 20 2006 010 296 11/2006

*Primary Examiner* — Gene Kim
*Assistant Examiner* — Alexander Niconovich
(74) *Attorney, Agent, or Firm* — Jacobson Holman PLLC

(57) ABSTRACT

A clay target trap machine including a clay target throwing machine (1) and associated target hopper or magazine (2) mounted on a base, the base being mounted on a carriage (8) movable automatically on rails (12) and able to throw clay targets from more than one position and at a number of different firing angles and heights.

12 Claims, 5 Drawing Sheets

(56) References Cited

U.S. PATENT DOCUMENTS

| | | | | | |
|---|---|---|---|---|---|
| 4,967,720 | A | * | 11/1990 | McCord et al. | 124/8 |
| 5,249,563 | A | * | 10/1993 | Patenaude | 124/8 |
| 5,359,576 | A | * | 10/1994 | Bunner et al. | 367/197 |
| 5,406,928 | A | * | 4/1995 | Panara et al. | 124/8 |
| 5,507,496 | A | * | 4/1996 | Yeung | 273/348 |
| 5,529,310 | A | * | 6/1996 | Hazard et al. | 273/362 |
| 5,704,341 | A | * | 1/1998 | Ritzenthaler | 124/8 |
| 5,771,874 | A | * | 6/1998 | Kohler | 124/8 |
| 5,857,451 | A | * | 1/1999 | Ciluffo et al. | 124/6 |
| 5,871,003 | A | * | 2/1999 | Laporte et al. | 124/9 |
| 5,937,839 | A | * | 8/1999 | Nilsson et al. | 124/8 |
| 5,970,969 | A | * | 10/1999 | Anttila et al. | 124/8 |
| 6,129,549 | A | * | 10/2000 | Thompson | 434/16 |
| 6,159,112 | A | * | 12/2000 | Ciluffo et al. | 473/451 |
| 6,173,705 | B1 | * | 1/2001 | DeWitt | 124/1 |
| 6,176,229 | B1 | * | 1/2001 | Patenaude | 124/8 |
| 6,276,350 | B1 | * | 8/2001 | Davey | 124/8 |
| 6,431,161 | B1 | * | 8/2002 | Gustafsson | 124/8 |
| 6,588,410 | B1 | * | 7/2003 | Graber | 124/8 |
| 6,684,550 | B2 | * | 2/2004 | Highfill | 42/94 |
| 7,263,986 | B2 | * | 9/2007 | Lovell | 124/9 |
| 7,488,176 | B2 | * | 2/2009 | Erdoss et al. | 434/16 |
| 8,276,573 | B2 | * | 10/2012 | Skell et al. | 124/8 |
| 2002/0194766 | A1 | * | 12/2002 | Highfill | 42/94 |
| 2006/0065258 | A1 | * | 3/2006 | Lovell | 124/9 |

* cited by examiner

TRENCH CLAY TARGET TRAP MACHINE

This is a national stage of PCT/NZ09/000,136 filed Jul. 8, 2009 and published in English, which claims the priority of New Zealand number 569677 filed Jul. 8, 2008, hereby incorporated by reference.

FIELD OF THE INVENTION

This invention relates to a trench/bunker trap machine and particularly to a clay target trap machine which emulates the International Shooting Sport Federation (ISSF) regulations for Olympic trap shooting (known as Olympic trap, Olympic trench or Olympic bunker shooting) and which replicates in one unit the ability to throw targets from more than one position and at a number of different firing angles.

BACKGROUND TO THE INVENTION

Trap shooting as an Olympic sport is operated under the rules of the ISSF. The rules set out the competition formats which have in the past required the use of fifteen purpose built machines located in a bunker. The individual machines are capable of being preset to throw targets at regulation heights and angles which are set down in the competition rules. Full details of the rules are available from the website of the ISSF which is available at www.issf-shooting.org/rules and the rules are incorporated herein by way of reference as if they were set out herein.

The cost of setting up a standard bunker is significant and because of this they are generally situated near major population centres to maximize usage. This constitutes a limitation on expansion of the sport and may mean that an out of town user incurs significant travel cost for regular practice.

In the past single target trap throwing machines have been used as a practice option for Olympic trap (regulation ISSF Olympic trap). However these single trap machines do not provide adjustable settings and they only fire from one position therefore limiting the angular orientation of the practice and not replicating competition format.

An object of the presentation is to overcome these disadvantages and provide a more affordable alternative Olympic trap clay target trap machine which is able to emulate the International Shooting Sport Federation (ISSF) regulations regarding target release positions, angles and height trajectories. Such a machine at least offers a useful alternative choice.

Further objects and advantages of the invention will become apparent from the following description which is given by way of example only.

SUMMARY OF THE INVENTION

According to the present invention there is provided a positioning mechanism/machine including a single clay target throwing machine and associated target hopper or magazine mounted on a base, the base being mounted on a carriage movable automatically on rails, channels or the like between positions which replicate any of the fifteen standard target release positions of a bunker/trench trap layout or ABT layout relative to a shooters firing position.

The orientation of the throwing machine being automatically adjustable by a control system so that in each of the three positions the single clay target throwing machine replicates the heights and angles required by ISSF regulations for the standard fifteen clay target throwing machines in a standard competition bunker.

The single clay target throwing machine can be mounted on the carriage on mountings with drive means capable of automatically, under the control of a computer based control system, adjusting the angular orientation of the throwing machine on X, C and Z axes.

The carriage can be mounted on a base frame designed for mounting in a trench or a bunker.

The base frame can have a set of spaced apart rails, for example a pair of opposed rails each of which is a lipped channel rail on which the carriage is mounted.

The carriage can be mounted on sliders which run in the lipped channel rails.

The carriage is moved on the rails by any suitable means such as a driven chain, belt or hydraulically/pneumatically by rams. Preferable the carriage is moved by way of a chain driven by an electric motor also controlled by the computer based control system to thereby move the carriage between selected positions on the track.

The target hopper can be a ten column carousel capable of storing up to 350 clay targets. This carousel can be of any number of columns holding any number of clay targets. Alternatively a magazine or the like can be used to store the clay targets. Such a carousel is described in U.S. Pat. No. 6,588,410.

In use any of the variety of known voice release, phono pull, systems can be used to activate release of the targets during practice or competition.

Further aspects of the invention which should be considered in all its novel aspects will become apparent from the following description which is given by way of example.

BRIEF DESCRIPTION OF THE DRAWINGS

A particular example of the invention will now be described with reference to the accompanying drawings in which.

DESCRIPTION OF THE PREFERRED EXAMPLE

In the example of the invention shown similar parts are referenced by the same numerals.

Figure 1:
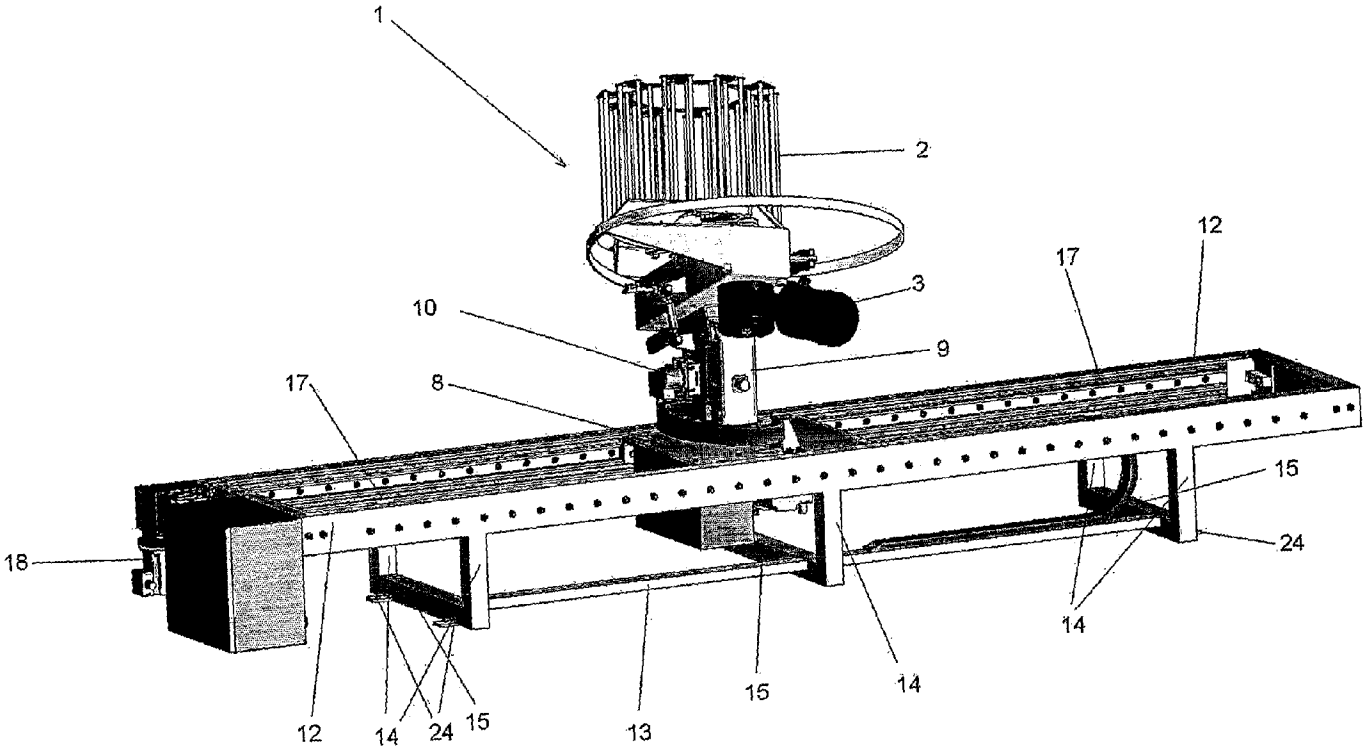
FIG. 1 is a perspective view from the front of an example of clay target trap machine according to one embodiment of the invention.
Figure 6:
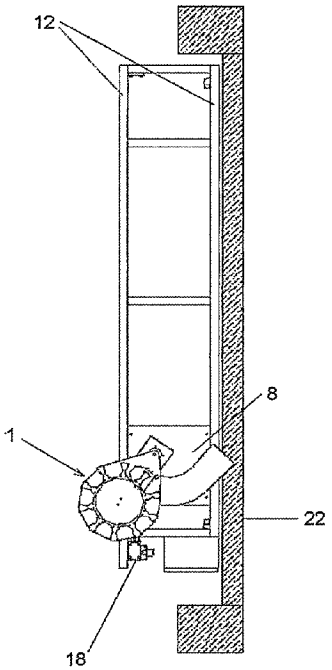
FIG. 6 is a plan view of the clay target trap machine shown in FIGS. 1 to 5 situated in a bunker of a trap shooting installation.
Figure 7:
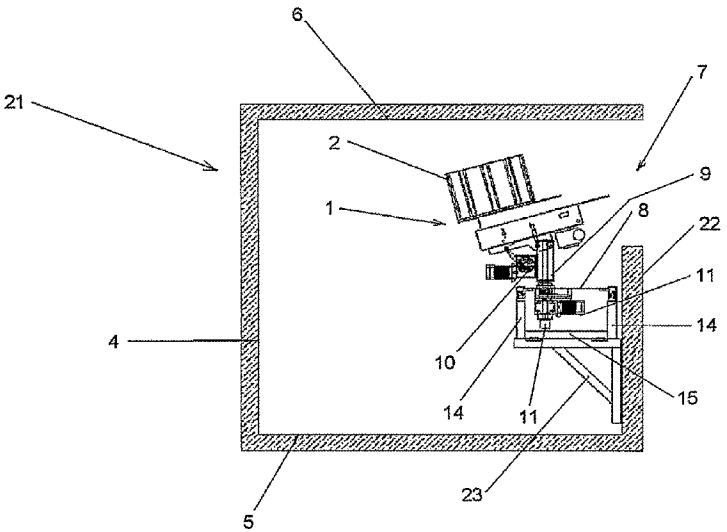
FIG. 7 is a vertical section through the bunker of the target trap shooting installation shown in FIG. 7.
Figure 8:
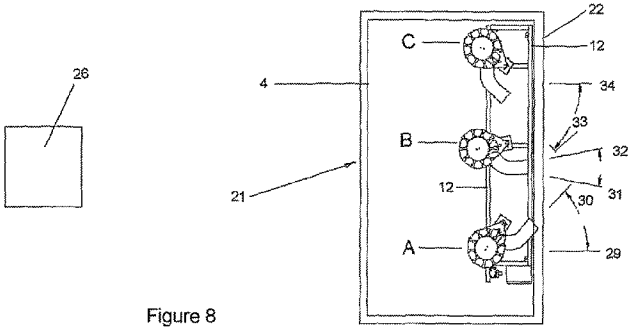
FIG. 8 is a plan view partly in section of a field layout including the target trap shooting installation shown in FIGS. 6 and 7 and in which the three regulated positions A, B and C are shown.

In FIG. 1 is shown a single clay target throwing machine generally indicated by arrow 1. The machine 1 has an associated target hopper such as carousel 2 and throwing mechanism driven in generally known manner by an electric drive motor 3. The carousel 2 and throwing mechanism can be of the general type described in U.S. Pat. No. 6,588,410 the content of which is incorporated herein by way of example. In FIGS. 6 to 8 the machine 1 is shown mounted in a bunker with rear wall 4, floor 5, roof 6 and opening at 7 through which the clay targets are thrown when the unit is in use. Alternatively (not shown) instead of the carousel 2 the throwing machine can incorporate a magazine style store for the clay targets.

The machine 1 is mounted on a carriage sub-frame 8 via a column or pillar 9. The position of machine 1 on the pillar 9 can be adjusted in a vertical plane through an horizontal axis by an electric motor and gearbox 10.

The position of pillar 9 can be adjusted around in an horizontal plane through the vertical axis by electric motor and gearbox 11.

The movement of the motors and gearboxes 10, 11 is controlled by a computer controller (not shown) which can be preset so that at different positions in the bunker the targets are thrown in accordance with the ISSF regulations.

The carriage sub-frame 8 is mounted on rails, channels or the like 12 which are mounted on a base 13 which in the example shown is an elongate frame with uprights 14 and cross members 15 shown in detail in FIGS. 1, 3 to 5.

The sub-frame 8 is preferably mounted on sliders 16 which run in the rails between positions which replicate three standard positions of a 15 trap bunker layout.

As used herein X, C and Z axes are defined as follows when a person looks at the throwing machine in plan view (from overhead):

- X axis is the left to right movement of the throwing machine on the slider rails and this places the clay target machine into its 3 different positions to throw targets from;
- Z axis is the up and down movement of the throwing machine and this gives the machine the ability to throw the target at different heights out of the bunker. This movement is delivered by motor/gearbox 10 shown in FIG. 1 and FIG. 7; and
- C axis is the rotational movement of the throwing machine and this gives the angles of the targets off the clay target machine as they are thrown out of a bunker. This movement is as delivered by the motor/gearbox 11 shown in FIG. 7.

Figure 3:
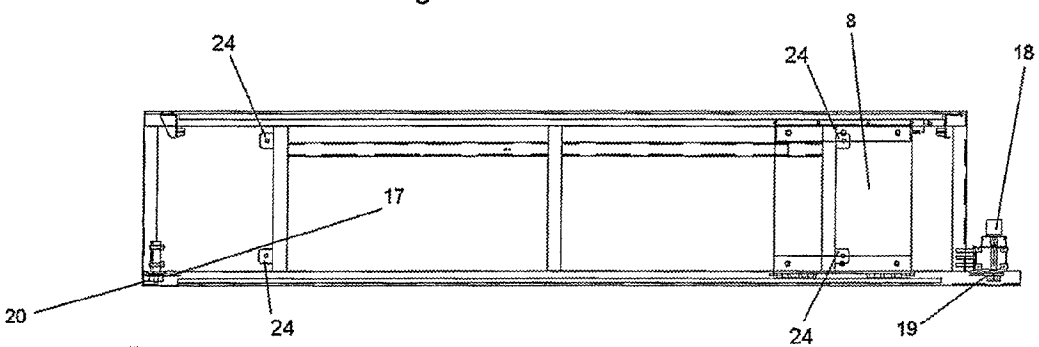
FIG. 3 is a plan view of a base frame for the clay target trap machine shown in FIGS. 1 and 2.

In the example, as shown in FIG. 3, the sub-frame 8 has a chain 17 (FIG. 4) driven by motor 18. The chain 17 extends alongside the rail from a sprocket 19 at the motor 18 to a sprocket 20 at the other end of the base 13.

The target hopper of the machine 1 can be a ten column carousel capable of storing up to 350 clay targets—or it could be any number of columns capable of storing any number of clay targets.

Figure 4:
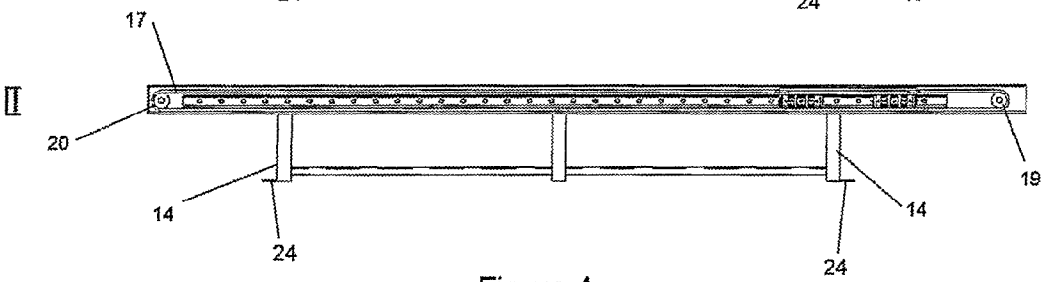
FIG. 4 is a rear view of the base frame shown in FIG. 3.

In use the machine 1 is mounted as shown in FIGS. 6 to 9 in a bunker generally indicated by arrow 21. The machine 1 is mounted on wall 22 of the bunker by brackets 23 (FIGS. 7 and 9) to which the base 13 is connected at 24 (FIGS. 1, 3 and 4).

Figure 9:
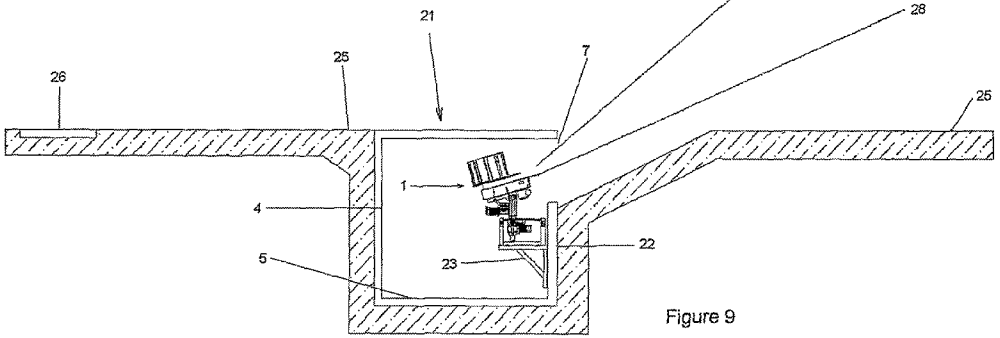
FIG. 9 is a vertical section through the field layout shown in FIG. 8.

The bunker 22 is itself part of a field layout shown in FIGS. 8 and 9. In FIGS. 8 and 9 ground level is indicated by arrow 25. The field layout has a shooting station at 26 and targets are thrown by machine 1 through the opening 7 of the bunker. In FIGS. 8 and 9 are shown the heights and angles required by ISSF regulations.

Figure 2:
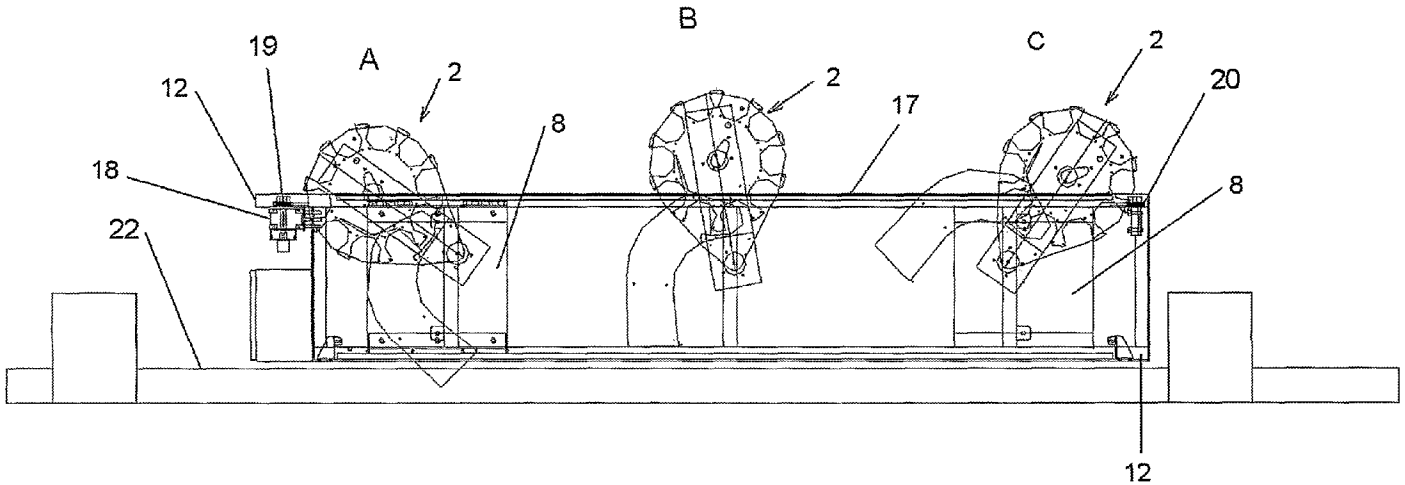
FIG. 2 is a plan view of the example clay target trap machine shown in FIG. 1 in which the three positions A, B and C demonstrate the three regulated positions that the clay target trap machine can move to on its sliders.
Figure 5:
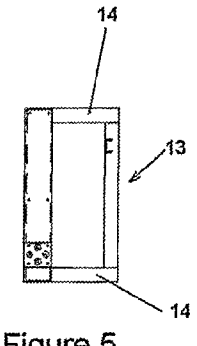
FIG. 5 is a section through the base frame shown in FIGS. 3 and 4.

In use the orientation on the sub-frame 8 of the machine 1 is automatically adjustable by the control system so that it is moved automatically and sequentially between each of its three positions A, B, C (shown in FIGS. 2 and 8) along the length of the base frame 13 in accordance with the ISSF rules for the particular competition. The sub-frame 8 is moved by way of the chain 17 driven by the electric motor 18 which is also controlled automatically by the computer based control system to move the frame 8 between selected positions on the track. The throwing angles in each of positions A, B, C being set by automatic rotation of the pillar 9 on sub-frame 8 under the control of electric motor 11. The target is released by the shooter using a voice release system which is interfaced with or incorporated within the control system.

In addition in each position A, B, C the vertical height of the thrown clay target can automatically be adjusted in the direction of target flight (the arrows 27 and 28 in FIG. 9 show the limits) as required by the ISSF rules. In FIG. 8 the lines 29, 30 show the horizontal angular throw limits for position A, lines 31, 32 the limits for position B and lines 33, 34 the limits for position C.

The control system may include a computer program which allows a number of pre-programmed selections to be made so that in any practice session or competition session a desired regular format is reproduced by the machine. In practice a voice release system can be used to activate firing of each target.

The single clay target throwing machine therefore replicates the heights and angles required by ISSF regulations for the standard fifteen clay target throwing machines in a standard competition bunker and is fully compliant with ISSF regulations in relation to target height, position and angle as referenced to the shooters position. The applicant's owners manual, the content of which is incorporated herein by way of reference incorporates a detailed explanation of how to set up one of the clay target throwing machines for competition or practice use.

Advantages of the invention include the following:

1. A purpose built machine for use in Olympic Bunker installations and will fit in a standard Olympic Bunker layout or a purpose built Olympic Bunker which is 20% the length of a standard Olympic Bunker;
2. All Olympic Bunker target presentations are pre-set and any one of the nine (9) programmes can be engaged by the press of a button;
3. Automatic positioning of the trap machine for target presentation once the trap is adjusted and set for height and direction with height marker;
4. Quick and easy set up of a machine for new target sequences;
5. Trap windage mechanism to ensure controlled level clay flight as required;
6. Solenoid release mechanism, or any known type of trap release mechanism, for instantaneous firing of the trap;
7. Only one trap machine simulates the normal fifteen trap machines in a full Olympic Bunker layout;
8. Practice target shooting on this machine by engaging just one target presentation if required;
9. Full squadded Olympic Bunker shooting can be conducted over this machine if the squad of shooters shoot single file/single target off the same shooting station;
10. One person setup and operation;
11. Reduced capital outlay allowing smaller clubs to shoot Olympic Bunker; and
12. The trap machine can be set to oscillate in both the horizontal and vertical axes continuously, such movement allowing the presentation of targets off the trap machine, which exactly meet the requirements of Automatic Ball Trap (ABT) clay target shooting. This selection is controlled through the engagement of one button on the controller and the trap machine will automatically locate to the central position B as indicated on FIG. 2.

Where in the preceding description particular mechanical integers are described it is envisaged that their mechanical equivalents can be used as if described herein.

Thus by the invention there is provided an alternative clay target trap machine which is fully compliant with International Shooting Sport Federation (ISSF) regulations in relation to target height, position and angle as referenced to the shooters position.

A particular example of the invention has been described and it is envisaged that improvements and modifications can take place without departing from the scope of the attached claims.

The invention claimed is:

1. A clay target trap machine comprising:

a single clay target throwing machine;

a target hopper or magazine connected with the single clay target throwing machine;

a base;

a carriage;

rails or channels; and a control system;

wherein the single clay target throwing machine is mounted on the base, the base being mounted on the carriage movable automatically on the rails or channels between positions in a bunker relative to a shooters firing position and;

wherein the single clay target throwing machine and the target hopper or magazine moves relative to and along the rails or channels so as to emulate the fifteen standard release positions of a bunker/trench trap layout or ABT layout as defined by Rules of the International Olympic Committee, and orientation of the single clay target throwing machine is automatically adjustable by the control system so that in each of three operating positions the single clay target throwing machine replicates the heights and angles required by International Shooting Sport Federation (ISSF) regulations for standard fifteen clay target throwing machines in a standard competition bunker.

2. The clay target trap machine as claimed in claim 1 wherein the single clay target throwing machine is mounted on the carriage on mountings with drive means capable of automatically, under the control of a computer based control system, adjusting the angular orientation of the throwing machine on X, C and Z axes; wherein X axis is left to right movement of the single clay target throwing machine on the rails or channels, Z axis is up and down movement of single clay target throwing machine, C axis is rotational movement of the single clay target throwing machine.

3. The clay target trap machine as claimed in claim 1 wherein the carriage is mounted on a base frame designed for mounting in a trench or a bunker.

4. The clay target trap machine as claimed in claim 3 wherein the base frame has a set of spaced apart rails each of which is a lipped channel rail on which the carriage is mounted.

5. The clay target trap machine as claimed in claim 4 wherein the carriage is mounted on sliders which run in the lipped channel rails.

6. The clay target trap machine as claimed in claim 1 wherein the carriage is moved on the rails by a driven chain, belt or hydraulically/pneumatically by rams.

7. The clay target trap machine as claimed in claim 6 wherein the carriage is moved by way of a chain driven by an electric motor which is controlled by the computer based control system to thereby move the carriage between selected positions on the track.

8. The clay target trap machine as claimed in claim 1 wherein the target hopper is a ten column carousel capable of storing up to 350 clay targets.

9. The clay target trap machine as claimed in claim 1 wherein the target hopper has a plurality of columns holding a plurality of clay targets.

10. The clay target trap machine as claimed in claim 1 wherein a magazine is used to store the clay targets.

11. The clay target trap machine as claimed in claim 1 wherein a voice release system or phono pull system is used to activate release of the targets during practice or competition.

12. A clay target trench field layout for competition or practice incorporating the clay target trap machine as claimed in claim 1.

* * * * *

UNITED STATES PATENT AND TRADEMARK OFFICE

CERTIFICATE OF CORRECTION

PATENT NO. : 8,677,983 B2
APPLICATION NO. : 12/737400
DATED : March 25, 2014
INVENTOR(S) : Callander et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 517 days.

Signed and Sealed this
Twenty-ninth Day of September, 2015

Michelle K. Lee

Michelle K. Lee
*Director of the United States Patent and Trademark Office*